United States Patent [19]

Murphy

[11] Patent Number: 5,011,137

[45] Date of Patent: Apr. 30, 1991

[54] VARIABLE RESISTANCE DEVICE FOR USE IN TRAINING SWIMMERS

[76] Inventor: Steven J. Murphy, 203 Avenue A, Redondo Beach, Calif. 90277

[21] Appl. No.: 471,868

[22] Filed: Jan. 29, 1990

[51] Int. Cl.[5] ..... A63B 69/12

[52] U.S. Cl. ..... 272/71; 272/1 B; 272/116; 441/55

[58] Field of Search ..... 272/71, 93, 116, 119, 272/130, 143, 1 B; 441/55

[56] References Cited

U.S. PATENT DOCUMENTS

| | | | |
|---|---|---|---|
| 3,142,485 | 7/1964 | Jacobsen | 272/116 |
| 3,226,114 | 12/1965 | Swider | 272/116 |
| 3,584,870 | 6/1971 | Garst | 272/71 X |
| 3,786,526 | 1/1974 | Ausseil | 272/71 X |
| 3,913,907 | 10/1975 | Baker | 272/71 X |
| 4,767,118 | 8/1988 | Ostergard | 272/116 X |

*Primary Examiner*—Robert Bahr
*Attorney, Agent, or Firm*—W. Edward Johansen

[57] ABSTRACT

A variable resistance device for use in training a swimmer includes an L-shaped scoop member, a belt and a surface area varying mechanism. The L-shaped scoop member is formed out of a relatively non-reflexible sheet of plastic material and has a support portion and resistance portion. The support portion is substantially a truncated triangle with a top edge and a bottom edge. The resistance portion is substantially a rectangle with a flat surface area, a first edge and a second edge which is contiguous with the bottom edge of the support portion. The resistance portion has a rectangular slot of a first cross-section. The belt is detachably coupled to the swimmer's torso and is hingedly coupled to the support portion of the L-shaped scoop member adjacent to the top edge thereof. The L-shaped scoop member is pivotally coupled to the belt in order not to interfere with the swimmer's stroke. The surface area varying mechanism includes a sliding member, two mounts and a securing mechanism. The sliding member is substantially a rectangle of a second cross-section which is larger than the first cross-section of the rectangle slot. The two mounts slidably couple the sliding member to the resistance portion. The swimmer selects the position of the sliding member to obtain the effective resistance of the flat surface area of the resistance portion of L-shaped scoop member to the swimmer. The securing mechanism secures the sliding member to the two mounts at the selected position.

3 Claims, 2 Drawing Sheets

Fig. 1.
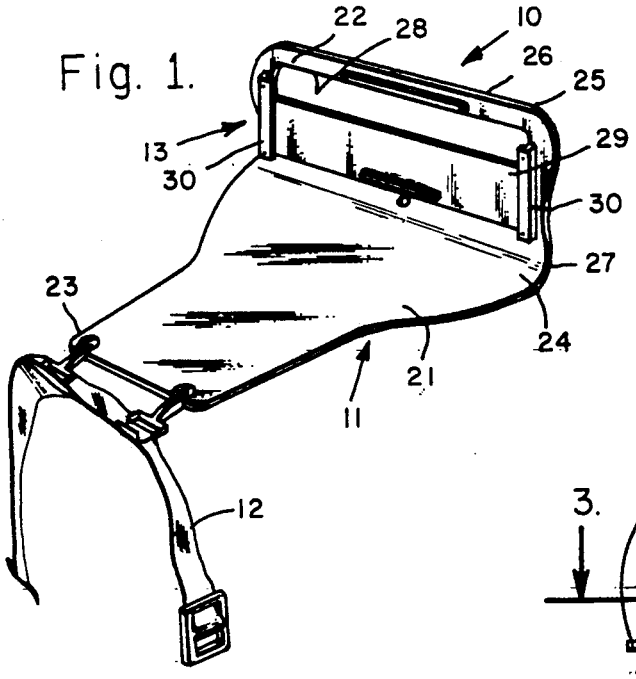
Fig. 2.
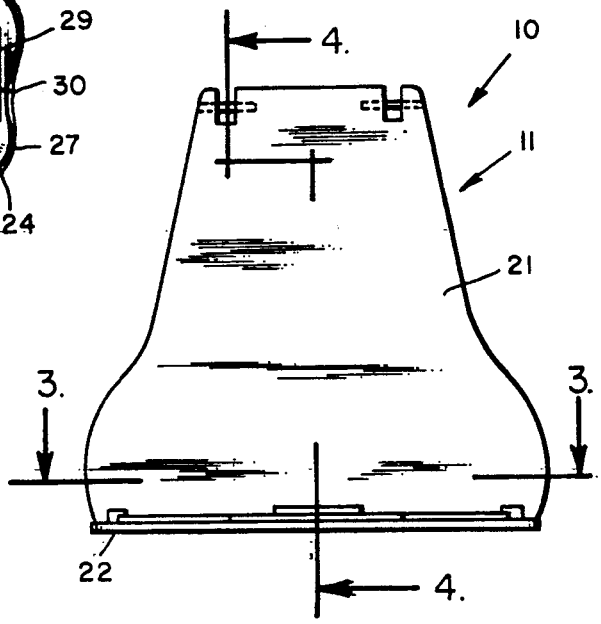
Fig. 3.
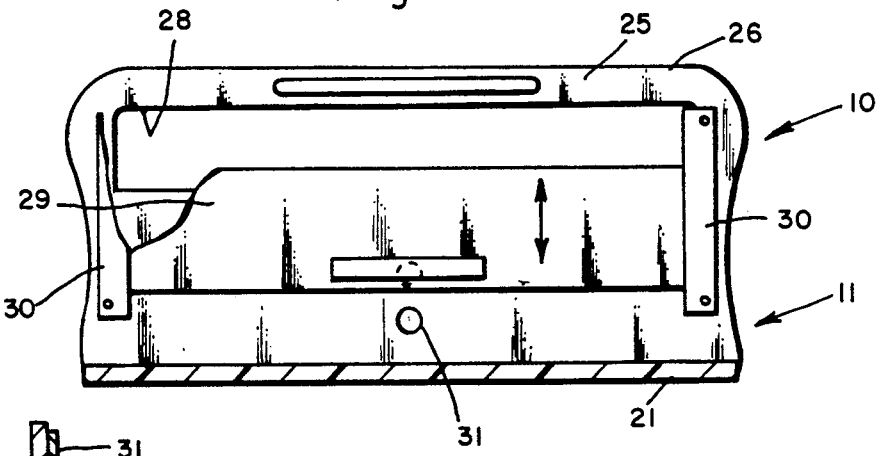
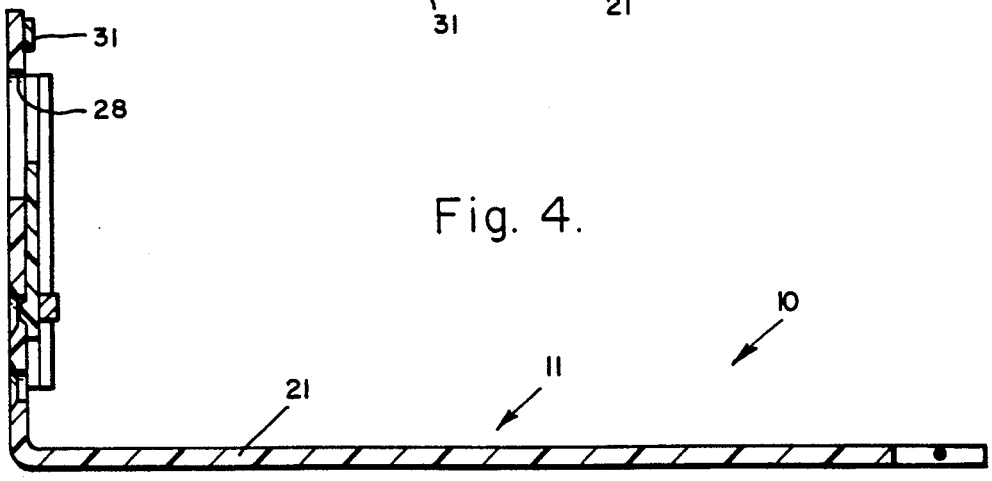
Fig. 4.

VARIABLE RESISTANCE DEVICE FOR USE IN TRAINING SWIMMERS

BACKGROUND OF THE INVENTION

1. Field of the Invention

The present invention relates to a training device for a swimmer and more particularly to a variable resistance device which does not interfere with a swimmer's stroke while allowing the swimmer to select the effective resistance of the variable resistance device to the swimmer and which a swimmer may use with or without a kickboard during his training for his events such as the freestyle, the butterfly stroke, the breast stroke and the back stroke.

2. Description of the Prior Art

In training competitive swimmers, it has been recognized that the development of the swimming muscles ranks in importance with the swimmer's technique and his endurance. One method of development that has been advocated is weight lifting but this is not completely satisfactory because the muscular development does not really correspond to that required for swimming. At the present time many coaches believe that a more appropriate way to develop swimming muscles is to increase the weight that the swimmer must carry and/or the resistance to his movement through the water while actually swimming laps during training. This strengthens the swimmer's endurance and his swimming muscles and thereby improving his competitive ability.

Swimmers have added weight and increased drag during practice sessions by wearing several T-shirts and either shorts or cut-off jeans over their regular suits. These extra garments must be carried to practice and extra wet garments must be carried back home. Increasing weight and drag by wearing additional garment also distributes the weight and drag unevenly on the swimmer which can increase the tendency for his body to roll or dip.

U.S. Pat. No. 3,142,485, entitled Swimmer Training Device, issued to Allen I. Jacobsen on July 28, 1964, teaches a swimmer training device which increases the resistance of a swimmer's body to his movement through water. The swimmer training device includes a flat resistance member, a support member which supports the flat resistance member and an attaching mechanism. The support member supports the flat resistance member. The attaching mechanism secures the support member to the swimmer's torso.

U.S. Pat. No. 3,517,930, entitled Variable Resistance Swimmer Training Device, issued to Allen I. Jacobsen on June 30, 1970, teaches a variable resistance swimmer training device which can be adjustably mounted on the body of a competitive swimmer and which provide predetermined resistances of varying degrees to the forward movement of the swimmer causing the swimmer to exert greater effort. The resistance is caused by members of varying shape and curvature mounted removably on the variable resistance swimmer training device and extending from the body at various degrees of angularity.

U.S. Pat. No. 3,548,870, entitled Resistance Member Attached to a Swimmer, issued to Edward A. Garst on June 15, 1971, teaches a swimmer's training device which includes an elongated pocket assembly having sidewalls hingedly connected together in a side-by-side relation and foldable end walls extended between and interconnected with the sidewalls. The end walls are of a size to permit movement of the sidewalls to a spread apart position to form an angle of substantially 90°. With the pockets extended transversely of the longitudinal axis of the body of the swimmer, one of the sidewalls is secured flat against the forward side of the swimmer's torso so that the pocket will open in the direction swimming movement. Thus, during swimming the pocket is opened by the action of the water against the second sidewall which function as a resistance member to impede the passage of the swimmer through the water. The resistance member is of a hinged construction to provide an outer foldable section that is foldable against the inner section of the resistance member to vary the resistance offered by the resistance against the swimmer's movement through the water.

U.S. Pat. No. 4,071,236, entitled Swimmer Drag Suit, issued to George Oprean on Jan. 31, 1978, a drag suit which includes a suit and a plurality of pockets on the front and back of the suit and which is to be worn over the regular suit of a swimmer. The drag suit adds weight and increases the resistance to the swimmer's movement through the water and thus helps in the development of swimming muscles. The increased drag is caused by the pockets which open in the direction of the swimmer's movement through the water. Water entering the pockets is impeded in flowing through them whereby drag is created. The pockets are located on the suit in such a manner that the drag is distributed evenly on the swimmer with no imbalance tending to cause the swimmer to roll or dip.

U.S. Pat. No. 4,302,007, entitled Swimmer's Drag Producing Belt, issued to George Oprean and James E. Counsilman on Nov. 24, 1981, teaches a drag producing belt which is to be worn over the regular suit of a swimmer. The drag producing belt adds weight and increases the resistance to the swimmer's movement through the water and thus helps in the development of swimming muscles. The increased drag is caused by normally open ended pockets which are secured to the belt in such a manner that they act as a scoop as the swimmer moves through the water. Water entering the pockets is impeded in flowing through them whereby drag is created. The pockets are located on the belt suit in such a manner that the drag is distributed evenly on the swimmer with no imbalance tending to cause the swimmer to roll or dip.

SUMMARY OF THE INVENTION

In view of the foregoing factors and conditions which are characteristic of the prior art it is the primary object of the present invention to provide a variable resistance device for use by a swimmer with or without a kickboard during his training for his events including the freestyle, the butterfly stroke, the breast stroke and the back stroke.

It is another object of the present invention to provide a variable resistance device which does not interfere with the swimmer's stroke.

It is still another object of the present invention to provide a variable resistance device which includes a resistance portion and which allows the swimmer to select the effective resistance of the resistance portion to the swimmer.

In accordance with the present invention an embodiment of a variable resistance device for use in training a swimmer is described. The variable resistance device includes an L-shaped scoop member, a belt and a surface area varying mechanism. The L-shaped scoop member is formed out of a relatively non-reflexible sheet of plastic material and has a support portion and resistance portion. The support portion is substantially a truncated triangle with a top edge and a bottom edge. The resistance portion is substantially a rectangle with a flat surface area, a first edge and a second edge which is contiguous with the bottom edge of the support portion. The resistance portion has a rectangular slot of a first cross-section. The belt is detachably coupled to the swimmer's torso and is hingedly coupled to the support portion of the L-shaped scoop member adjacent to the top edge thereof. The L-shaped scoop member is pivotally coupled to the belt in order not to interfere with the swimmer's stroke. The surface area varying mechanism includes a sliding member, two mounts and a securing mechanism. The sliding member is substantially a rectangle of a second cross-section which is larger than the first cross-section of the rectangular slot. The two mounts slidably couple the sliding member to the resistance portion. The swimmer selects the position of the sliding member to obtain the effective resistance of the flat surface area of the resistance portion of L-shaped scoop member to the swimmer. The securing mechanism secures the sliding member to the two mounts at the selected position.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE DRAWING

FIG. 1 is a perspective drawing of a variable resistance device for use in training a swimmer which includes an L-shaped scoop member having a support portion and a resistance portion, a belt and a surface area varying mechanism which varies the effective resistance of the resistance portion to the swimmer's body in water and which has been constructed in accordance with the principles of the present invention.

FIG. 2 is a rear elevational view of the variable resistance device of FIG. 1.

FIG. 3 is a cross-sectional view of the support portion surface area varying mechanism of the L-shaped scoop member of the variable resistance device of FIG. 1 taken along the line 3—3 of FIG. 2.

FIG. 4 is a cross-sectional view of the support portion surface area varying mechanism of the L-shaped scoop member of the variable resistance device of FIG. 1 taken along the line 4—4 of FIG. 2.

DESCRIPTION OF THE PREFERRED EMBODIMENT

Figure 5:
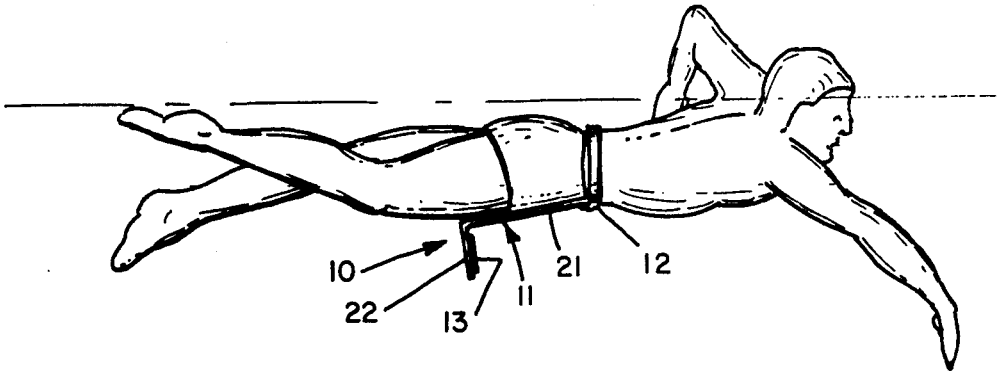
FIG. 5 is a schematic drawing of a swimmer using the variable resistance device of FIG. 1 during training for the freestyle event.
Figure 6:
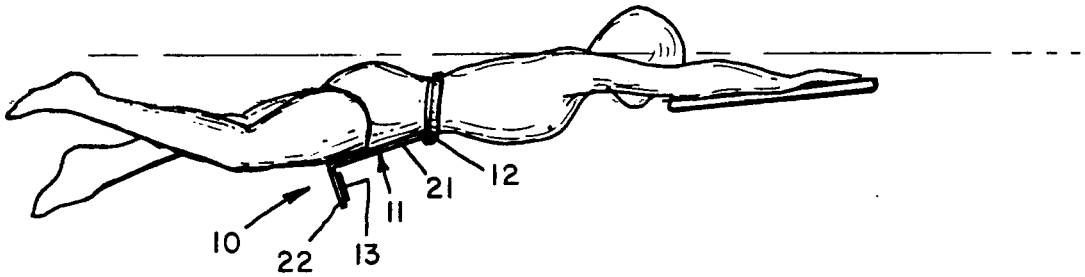
FIG. 6 is a schematic drawing of a swimmer using the variable resistance device of FIG. 1 with a kickboard during training for the freestyle event.
Figure 7:
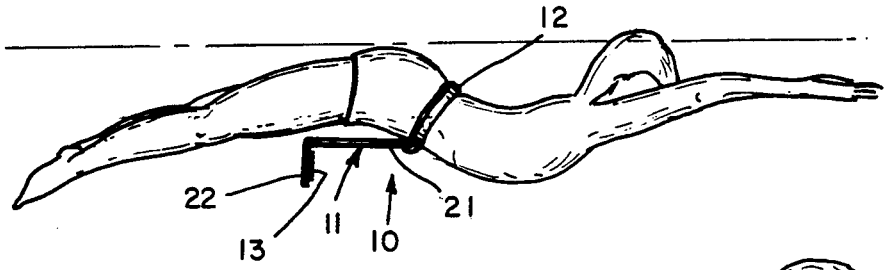
FIG. 7 is a schematic drawing of a swimmer using the variable resistance device of FIG. 1 during training for the butterfly event.
Figure 8:
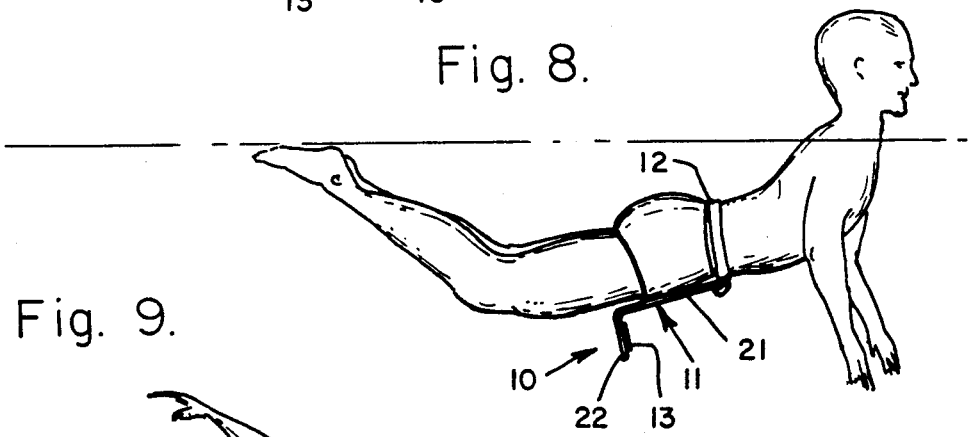
FIG. 8 is a schematic drawing of a swimmer using the variable resistance device of FIG. 1 also during training for the butterfly event.
Figure 9:
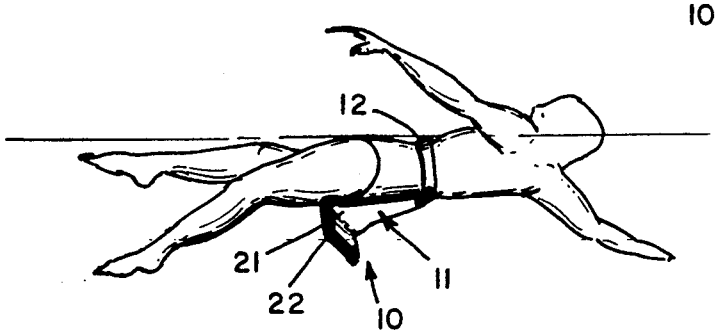
FIG. 9 is a schematic drawing of a swimmer using the variable resistance device of FIG. 1 during training for the back stroke event.

In order to understand the present invention it is necessary to refer to the following description of its preferred embodiment in conjunction with the accompanying drawing. Referring to FIG. 1 a variable resistance device 10 is for use in training a swimmer. The variable resistance device 10 includes an L-shaped scoop member 11, a belt 12 and a surface area varying mechanism 13. The L-shaped scoop member 11 is formed out of a relatively non-reflexible sheet of plastic material, such as plexiglass, and has a support portion 21 and resistance portion 22.

Referring to FIG. 2 in conjunction with FIG. 1 the support portion 21 is substantially a truncated triangle with a top edge 23 and a bottom edge 24. The belt 12 is hingedly coupled to the support portion 21 of the L-shaped scoop member 11 adjacent to the top edge 23 thereof.

Referring to FIG. 3 in conjunction with FIG. 1 the resistance portion 22 of the L-shaped scoop member 11 is substantially a rectangle with a flat surface area 25, a first edge 26 and a second edge 27 which is contiguous with the bottom edge 24 of the support portion 21. The resistance portion 22 has a rectangular slot 28 of a first cross-section.

Referring to FIG. 4 in conjunction with FIG. 1 and FIG. 3 the surface area varying mechanism 13 includes a sliding member 29, two mounts 30, which are formed out of Teflon-type material, and a securing mechanism 31. The sliding member 29 is substantially a rectangle of a second cross-section which is larger than the first cross-section of the rectangular slot 28. The two mounts 30 slidably couple the sliding member 29 to the resistance portion 22 of the L-shaped scoop member 11.

Referring to FIG. 1 in conjunction with FIG. 5 the belt 12 is detachably coupled to the swimmer's torso so that the L-shaped scoop member 11 is pivotally coupled to the belt 12 in order not to interfere with the swimmer's stroke. The swimmer selects the position of the sliding member 29 to obtain the effective resistance of the flat surface area of the resistance portion 22 of L-shaped scoop member 11 to the swimmer. The securing mechanism 31 secures the sliding member 29 to the two mounts 30 at the selected position.

Referring to FIG. 1 in conjunction with FIG. 6, FIG. 7, FIG. 8 and FIG. 9 the variable resistance device 10 does not interfere with a swimmer's stroke while allowing him to select the effective resistance of the variable resistance device 10 to the swimmer in the water. The swimmer may use the variable resistance device 10 with or without a kickboard during his training for his events such as the freestyle, the butterfly stroke, the breast stroke and the back stroke.

From the foregoing it can be seen that a variable resistance device for use in training a swimmer has been described. It should be noted that the sketches are not drawn to scale and that distance of and between the figures are not to be considered significant.

Accordingly it is intended that the foregoing disclosure and showing made in the drawing shall be considered only as an illustration of the principles of the present invention.

What is claimed is:

1. A variable resistance device for use in training a swimmer, said variable resistance device comprising:

a. a belt which is disposable around the swimmer's torso and securable thereto;

b. an L-shaped scoop member which is integrally formed out of a relatively non-reflexible sheet of plastic material having a support portion which is substantially in the shape of a truncated triangle with a top edge and a bottom edge and a resistance portion which has a flat surface area and which is substantially in the shape of a rectangle with a frist edge and a second edge which is contiguous with said bottom edge of said support portion;

b. attaching means for loosely attaching said L-shaped scoop member to said belt so that said L-shaped scoop member may move in response to the swimmer's movement; and c. surface area varying means for varying said flat surface area of said resistance portion of said L-shaped scoop member so that effective resistance of said flat surface area to the swimmer is variable.

2. A variable resistance device for use in training a swimmer according to claim 1 wherein said attaching means comprises:

a. a belt which is detachably coupled to the swimmer's torso; and b. belt coupling means for hingedly coupling said belt to said support portion of said L-shaped scoop member adjacent to said top edge thereof so that said L-shaped scoop member becomes pivotally coupled to said belt in order not to interfere with the swimmer's stroke.

3. A variable resistance device for use in training a swimmer according to claim 1 wherein said resistance portion of said L-shaped scoop member has a rectangular slot of a first cross-section and said surface area varying means comprises:

a. a sliding member which is rectangular in shape and of a second cross-section which is larger than said first cross-section of said rectangular slot;

b. two mounts which couple said sliding member to said resistance portion of said L-shaped scoop member contiguous and adjacent thereto; and c. securing means for securing said sliding member in a position on said two mounts whereby the effective resistance of said flat surface area to the swimmer is fixed by the swimmer.

* * * * *